US010153557B2

(12) United States Patent
Sudo

(10) Patent No.: US 10,153,557 B2
(45) Date of Patent: Dec. 11, 2018

(54) ANTENNA MODULE

(71) Applicant: Murata Manufacturing Co., Ltd., Kyoto (JP)

(72) Inventor: Kaoru Sudo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 56 days.

(21) Appl. No.: 15/491,093

(22) Filed: Apr. 19, 2017

(65) Prior Publication Data

US 2017/0222325 A1 Aug. 3, 2017

Related U.S. Application Data

(63) Continuation of application No. PCT/JP2015/078916, filed on Oct. 13, 2015.

(30) Foreign Application Priority Data

Oct. 20, 2014 (JP) ..... 2014-213782

(51) Int. Cl.
*H01Q 1/00* (2006.01)
*H01Q 13/08* (2006.01)
(Continued)

(52) U.S. Cl.
CPC ..... *H01Q 13/08* (2013.01); *H01Q 1/38* (2013.01); *H01Q 9/0457* (2013.01); *H01Q 9/16* (2013.01);
(Continued)

(58) Field of Classification Search
CPC ..... H01Q 13/08; H01Q 21/30; H01Q 21/062; H01Q 1/38; H01Q 9/0457; H01Q 9/16; H01Q 21/08; H01Q 21/24
(Continued)

(56) References Cited

U.S. PATENT DOCUMENTS 6,831,614 B2 * 12/2004 Hsiao ..... H01Q 1/38 343/700 MS
8,179,325 B2 * 5/2012 Edwards ..... H01Q 9/0407 343/700 MS
(Continued)

FOREIGN PATENT DOCUMENTS

JP 2004282263 A 10/2004
JP 2007534196 A 11/2007
(Continued)

OTHER PUBLICATIONS

International Search Report for PCT/JP2015/078916 dated Dec. 1, 2015.
Written Opinion for PCT/JP2015/078916 dated Dec. 1, 2015.

*Primary Examiner* — Khai M Nguyen
(74) *Attorney, Agent, or Firm* — Pearne & Gordon LLP

(57) ABSTRACT

A first dipole antenna is included in a first layer of a dielectric substrate, a second dipole antenna which excites polarized waves in a direction orthogonal to a direction of polarized waves excited by the first dipole antenna is included in a second layer. Power is supplied from a first power supply line to the first dipole antenna and from a second power supply line to the second dipole antenna. The operating frequencies of the first dipole antenna and the second dipole antenna are the same as each other. A distance from an intermediate point between two power supply points of the first dipole antenna to an intermediate point between two power supply points of the second dipole antenna is no greater than an effective wavelength of the operating frequency. At least one of the first power supply line and the second power supply line has a triplate structure.

7 Claims, 3 Drawing Sheets

(51) Int. Cl.

| | |
|---|---|
| ***H01Q 9/16*** | (2006.01) |
| ***H01Q 21/08*** | (2006.01) |
| ***H01Q 21/24*** | (2006.01) |
| ***H01Q 9/04*** | (2006.01) |
| ***H01Q 1/38*** | (2006.01) |
| ***H01Q 21/06*** | (2006.01) |
| ***H01Q 21/30*** | (2006.01) |

(52) U.S. Cl.
CPC ..... *H01Q 21/062* (2013.01); *H01Q 21/08* (2013.01); *H01Q 21/24* (2013.01); *H01Q 21/30* (2013.01)

(58) Field of Classification Search
USPC ..... 343/700 MS, 904–905
See application file for complete search history.

(56) References Cited

U.S. PATENT DOCUMENTS

| | | | |
|---|---|---|---|
| 2005/0040994 | A1 | 2/2005 | Mazoki et al. |
| 2010/0280340 | A1 | 11/2010 | Homan et al. |
| 2011/0006960 | A1 | 1/2011 | Edwards et al. |
| 2013/0300624 | A1 | 11/2013 | Fakharzadeh Jahromi |

FOREIGN PATENT DOCUMENTS

| | | | |
|---|---|---|---|
| JP | 4603098 | B2 | 12/2010 |
| JP | 2012156943 | A | 8/2012 |

* cited by examiner

ANTENNA MODULE

This is a continuation of International Application No. PCT/JP2015/078916 filed on Oct. 13, 2015 which claims priority from Japanese Patent Application No. 2014-213782 filed on Oct. 20, 2014. The contents of these applications are incorporated herein by reference in their entireties.

BACKGROUND

Technical Field

The present disclosure relates to an antenna module in which two dipole antennas which excite polarized waves orthogonal to each other are formed to a dielectric substrate.

Patent Document 1, indicated below, discloses a printed dipole antenna arranged on a dielectric substrate. One of a pair of radiation elements of the dipole antenna is formed on one surface of the dielectric substrate, and the other radiation element is formed on the other surface. This dielectric substrate passes through an opening portion provided to a reflector. Each of the surfaces on both sides of the dielectric substrate is provided with a terminal. These terminals are conducted to each other using a through-hole provided in the dielectric substrate.

By an edge of the opening portion of the reflector being connected to the terminal of the dielectric substrate, a conductor in the through-hole functions as a part of the reflector. A substantial dimension of the opening portion of the reflector is reduced, and thus resonance of the opening portion can be prevented.

Patent Document 2, indicated below, discloses an end-fire multilayer antenna in which two printed dipole antennas are formed on one substrate. The two dipole antennas are arranged sufficiently distanced from each other in comparison with a wavelength corresponding to an operating frequency. The antenna is designed to reduce coupling between the two dipole antennas.

Patent Document 1: Japanese Unexamined Patent Application Publication No. 2004-282263

Patent Document 2: U.S. Patent Application Publication No. 2013/0300624

BRIEF SUMMARY

In the antenna having a structure disclosed in Patent Document 1, it is difficult to arrange the two dipole antennas which excite polarized waves orthogonal to each other on one substrate. In the end-fire multilayer antenna disclosed in Patent Document 2, the distance between the antennas is sufficiently long in comparison with the wavelength. When the two antennas are brought close to each other, the coupling between the two antennas caused by power supply lines of the antennas may be a cause of reducing antenna characteristics.

The present disclosure provides an antenna module capable of reducing coupling between antennas caused by a power supply line, even when two dipole antennas are arranged to one substrate with an interval of approximately a wavelength corresponding to an operating frequency or an interval narrower than the wavelength.

An antenna module according to a first aspect of the present disclosure includes:

a dielectric substrate;

a first dipole antenna included in a first layer of the dielectric substrate;

a second dipole antenna included in a second layer different from the first layer of the dielectric substrate, and exciting a polarized wave in a direction orthogonal to a direction of a polarized wave excited by the first dipole antenna;

a first power supply line included in the first layer, and supplying power to the first dipole antenna; and a second power supply line included in the second layer, and supplying power to the second dipole antenna, in which an operating frequency of the first dipole antenna and an operating frequency of the second dipole antenna are the same as each other;

a distance from an intermediate point between two power supply points of the first dipole antenna to an intermediate point between two power supply points of the second dipole antenna is no greater than an effective wavelength of the operating frequency; and at least one of the first power supply line and the second power supply line has a triplate structure.

At least one of the first power supply line and the second power supply line has the triplate structure, and thus coupling between the antennas caused by the power supply line can be reduced.

An antenna module according to a second aspect of the present disclosure, in addition to the configuration of the antenna module according to the first aspect, further includes:

a first array antenna included in the first layer, and including the first dipole antenna at an end portion as a single antenna element; and a second array antenna included in the second layer, and including the second dipole antenna at an end portion as a single antenna element, in which a direction in which the antenna element of the first array antenna is arrayed and a direction in which the antenna element of the second array antenna is arrayed are orthogonal to each other.

The first array antenna and the second array antenna have directivity in a direction parallel to the dielectric substrate. A range in an azimuth angle direction in which a main lobe of the first array antenna is scanned is continuous with a range in an azimuth angle direction in which a main lobe of the second array antenna is scanned.

In an antenna module according to a third aspect of the present disclosure, in addition to the configuration of the antenna module according to the second aspect, the first array antenna and the second array antenna are arranged along sides of the dielectric substrate orthogonal to each other, and have the directivity in a direction parallel to the dielectric substrate, the antenna module further includes a patch antenna included in a third layer of the dielectric substrate different from both the first layer and the second layer, in which the patch antenna is arranged in a region further inward than the first array antenna and the second array antenna, when viewed in a plan view (viewed from a direction perpendicular to the surface of the dielectric substrate).

The patch antenna has the directivity in a normal direction (boresight direction) to the front surface of the dielectric substrate.

In an antenna module according to a fourth aspect of the present disclosure, in addition to the configuration of the antenna module according to the third aspect, the first power supply line and the second power supply line overlap with the patch antenna, when viewed in a plan view.

At least one of the first power supply line and the second power supply line has the triplate structure, and thus coupling between the patch antenna and the dipole antenna caused by the first power supply line or the second power supply line can be reduced.

An antenna module according to a fifth aspect of the present disclosure, in addition to the configurations of the antenna modules according to the second to fourth aspects, further includes, a vertical-type dipole antenna arranged to the dielectric substrate, and forming a pair with each antenna element of the first array antenna, in which the vertical-type dipole antenna includes a pair of conductor columns extending in a thickness direction of the dielectric substrate, and configures a cross dipole antenna with the corresponding antenna element of the first array antenna.

Radio waves having a polarized wave direction perpendicular to the dielectric substrate can be emitted in a direction parallel to the dielectric substrate.

At least one of a first power supply line and a second power supply line has a triplate structure, and thus coupling between antennas caused by the power supply line can be reduced.

DETAILED DESCRIPTION

First Embodiment

Figure 1A:
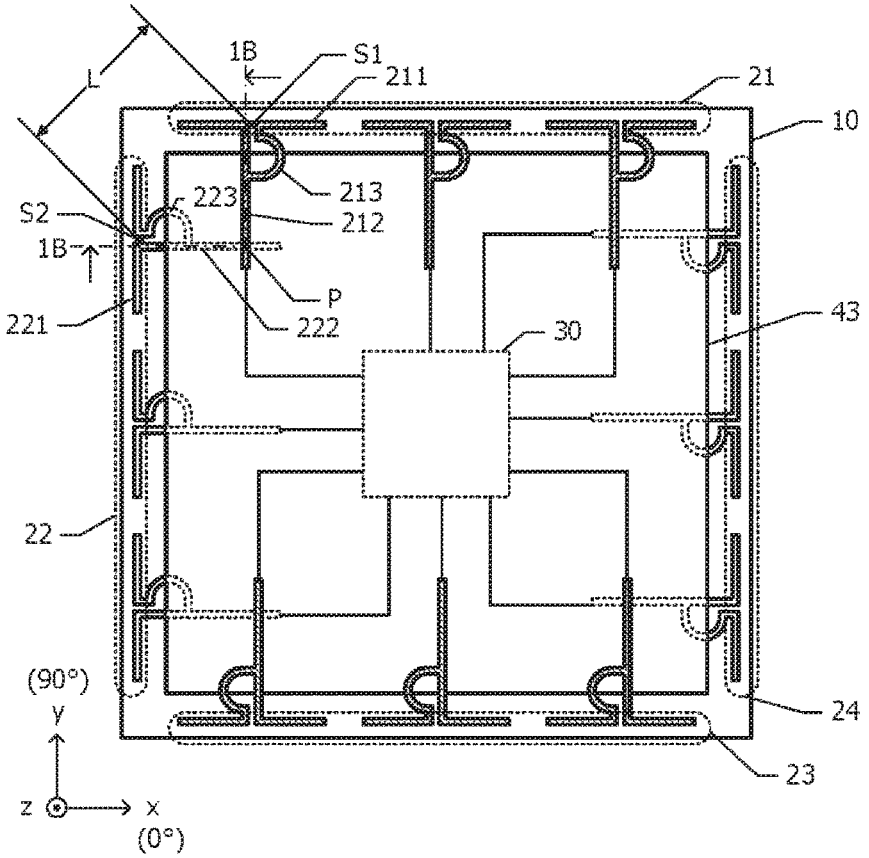
FIG. 1A is a plan cross sectional view of an antenna module according to a first embodiment.

FIG. 1A is a plan cross sectional view illustrating an antenna module according to a first embodiment. An xyz orthogonal coordinate system in which a surface parallel to a front surface of a dielectric substrate 10 is represented by an xy plane and a normal direction is represented by a z axis is defined. A positive direction of an x axis is defined as an azimuth angle of 0°. An azimuth angle of a y axis in a positive direction is 90°, an azimuth angle of the x axis in a negative direction is 180°, and an azimuth angle of the y axis in a negative direction is 270°. A planar shape of the dielectric substrate 10 is square or rectangular having sides parallel to the x axis or the y axis.

A first array antenna 21 is arranged along a side of the dielectric substrate facing in a direction of the azimuth angle of 90°. A second array antenna 22 is arranged along a side facing in a direction of the azimuth angle of 180°. A third array antenna 23 is arranged along a side facing in a direction of the azimuth angle of 270°. A fourth array antenna 24 is arranged along a side facing in a direction of the azimuth angle of 0°.

The first array antenna 21 includes a plurality of antenna elements arrayed along the corresponding side. The second array antenna 22, the third array antenna 23, and the fourth array antenna 24 include a plurality of antenna elements arrayed along the corresponding sides in the same manner. Each antenna element is a printed dipole antenna constituted by a radiation element parallel to the corresponding side. The antenna elements have the same operating frequency.

Each dipole antenna of the first array antenna 21 and each dipole antenna of the third array antenna 23 excite polarized waves parallel to the x axis. Each dipole antenna of the second array antenna 22 and each dipole antenna of the fourth array antenna 24 excite polarized waves parallel to the y axis. The first array antenna 21, the second array antenna 22, the third array antenna 23, and the fourth array antenna 24 operate as an end-fire antenna having directivity in a direction parallel to the dielectric substrate 10.

The first array antenna 21 can scan a main lobe of a directivity pattern in the azimuth angle direction with the direction of the azimuth angle of 90° as the center. The second array antenna 22 can scan the main lobe of the directivity pattern in the azimuth angle direction with the direction of the azimuth angle of 180° as the center. The third array antenna 23 can scan the main lobe of the directivity pattern in the azimuth angle direction with the direction of the azimuth angle of 270° as the center. The fourth array antenna 24 can scan the main lobe of the directivity pattern in the azimuth angle direction with the direction of the azimuth angle of 0° as the center.

A dipole antenna 211 of the first array antenna 21 arranged at an end portion on a negative side of the x axis (hereinafter, referred to as a "first dipole antenna") will be described. When viewed in a plan view (viewed in a direction perpendicular to a surface of the dielectric substrate 10), from the first dipole antenna 211 toward an inner side of the dielectric substrate 10, a first balun (balanced-to-unbalanced converter) 213 and a first power supply line 212 extend. The first balun 213 and the first power supply line 212 are formed by a conductor pattern of the same layer as the first dipole antenna 211. The first dipole antenna 211 is supplied with power from a high-frequency element 30 through a transmission line in the dielectric substrate 10, the first power supply line 212, and the first balun 213. The high-frequency element 30 is mounted on a rear surface of the dielectric substrate 10, for example.

A second balun 223 and a second power supply line 222 are also connected to a dipole antenna 221 of the second array antenna 22 arranged at an end portion on a positive side of the y axis (hereinafter, referred to as a "second dipole antenna") in the same manner. Other dipole antennas also have the same configuration as the first dipole antenna 211.

The first dipole antenna 211 and the second dipole antenna 221 are arranged such that a distance L from an intermediate point S1 between two power supply points of the first dipole antenna 211 to an intermediate point S2 between two power supply points of the second dipole antenna 221 is no greater than an effective wavelength corresponding to an operating frequency. Here, the "effective wavelength" refers to an actual wavelength taking into consideration a dielectric constant of a region which is focused on.

A direction of polarized waves excited by the first dipole antenna 211 and a direction of polarized waves excited by the second dipole antenna 221 are orthogonal to each other. Accordingly, the first dipole antenna 211 and the second dipole antenna 221 are weakly coupled with each other.

The first array antenna 21 and the third array antenna 23 are arranged in the same layer. The second array antenna 22 and the fourth array antenna 24 are arranged in the same layer below the first array antenna 21. The first dipole antenna 211 and the second dipole antenna 221 are arranged close to each other, and thus the first power supply line 212 and the second power supply line 222 partially overlap, when viewed in a plan view.

In a thickness direction (a direction perpendicular to the surface of the dielectric substrate 10), a ground layer 43 is arranged between the first array antenna 21 and the second array antenna 22. The ground layer 43 covers a region further inward than a location where the balun connected to each dipole antenna is arranged, when viewed in a plan view. The ground layer 43 is provided with an opening for arranging an interlayer connection conductor as necessary.

Figure 1B:
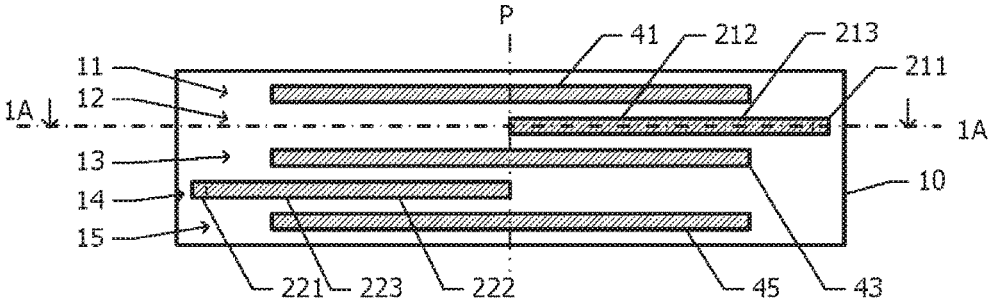
FIG. 1B is a cross-sectional view taken along a dot-dash line 1B-1B in FIG. 1A.

FIG. 1B is a cross-sectional view taken along a dot-dash line 1B-1B in FIG. 1A. The dot-dash line 1B-1B bends at a point P at a right angle. The dielectric substrate 10 has a multilayer structure, a plurality of layers 11 to 15 are arranged in the dielectric substrate 10. FIG. 1A is a plan cross sectional view taken at a position along the layer 12 which is a second layer from the top.

The first dipole antenna 211, the first power supply line 212, and the first balun 213 are included in the layer 12 which is the second layer from the top. Likewise, other dipole antennas, baluns, and power supply lines of the first array antenna 21 and the third array antenna 23 are also included in the layer 12 which is the second layer from the top. The second dipole antenna 221, the second power supply line 222, and the second balun 223 are included in the layer 14 which is a fourth layer from the top. Likewise, other dipole antennas, baluns, and power supply lines of the second array antenna 22 and the fourth array antenna 24 are also included in the layer 14 which is the fourth layer from the top.

The layer 11 which is the uppermost layer includes a ground layer 41, the layer 13 which is a third layer from the top includes the ground layer 43, and the layer 15 which is a fifth layer from the top includes a ground layer 45. The first power supply line 212 and at least a part of the first balun 213 have a triplate structure interposed between the ground layer 41 and the ground layer 43. The second power supply line 222 and at least a part of the second balun 223 have the triplate structure interposed between the ground layer 43 and the ground layer 45. Likewise, the power supply lines and at least parts of the baluns, which are connected to other dipole antennas, of the first array antenna 21, the second array antenna 22, the third array antenna 23, and the fourth array antenna 24 also have the triplate structure. Accordingly, the coupling between the antennas caused by the power supply line can be reduced. The coupling between the antennas is reduced, which can reduce loss caused by the coupling in a directivity pattern after phase synthesis by the array antenna as well.

In the first embodiment, however, both the first power supply line 212 and the second power supply line 222 have the triplate structure, only one thereof may have the triplate structure, and the other may have a microstrip line. Only one of the first power supply line 212 and the second power supply line 222 having the triplate structure reduces the coupling between the antennas as well.

In the first embodiment, the first array antenna 21, the second array antenna 22, the third array antenna 23, and the fourth array antenna 24 are respectively arranged at four sides of the dielectric substrate 10 which is square or rectangular. As an example of other configurations, a configuration may be such that the array antennas are respectively arranged at three sides or two sides orthogonal to each other, and the array antennas are not arranged at the other sides.

Second Embodiment

An antenna module according to a second embodiment will be described with reference to FIG. 2A and FIG. 2B. The following describe differences from the antenna module according to the first embodiment illustrated in FIG. 1A and FIG. 1B, and omit description of the common configuration.

Figure 2A:
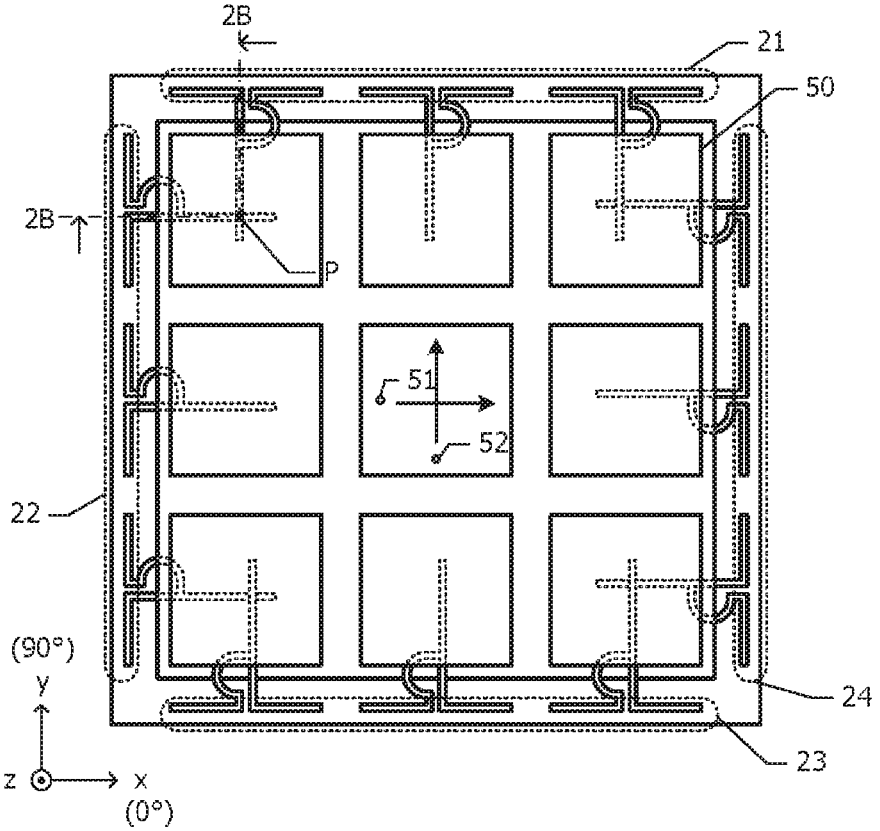
FIG. 2A is a plan view of an antenna module according to a second embodiment.

FIG. 2A is a plan view illustrating the antenna module according to the second embodiment. A plurality of patch antennas 50 are arranged in a region surrounded by the first array antenna 21, the second array antenna 22, the third array antenna 23, and the fourth array antenna 24. As one example, when the x-axis direction is defined as a row direction and the y-axis direction is defined as a column direction, the patch antennas 50 are arranged in a matrix form of 3 rows and 3 columns. The patch antenna 50 has a square planar shape having sides parallel to the x axis or the y axis.

Each patch antenna 50 is provided with a first power supply point 51 and a second power supply point 52. The first power supply point 51 is arranged at a location displaced from the center point of the patch antenna 50 in the x-axis direction. The second power supply point 52 is arranged at a location displaced from the center point of the patch antenna 50 in the y-axis direction. When the patch antenna 50 is supplied with power from the first power supply point 51, polarized waves parallel to the x axis are excited. When the patch antenna 50 is supplied with power from the second power supply point 52, polarized waves parallel to the y axis are excited.

Figure 2B:
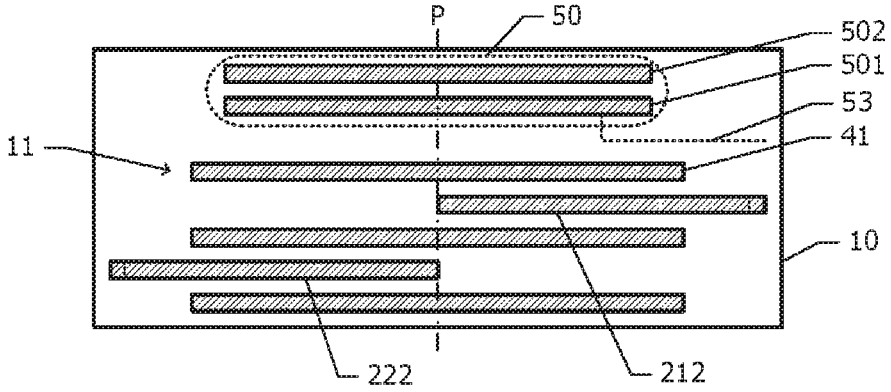
FIG. 2B is a cross-sectional view taken along a dot-dash line 2B-2B in FIG. 2A.

FIG. 2B is a cross-sectional view taken along a dot-dash line 2B-2B in FIG. 2A. The dot-dash line 2B-2B bends at a point P at a right angle. The patch antenna 50 includes a power supply element 501 and a parasitic element 502 electromagnetically coupled with each other. The power supply element 501 is arranged above the ground layer 41, and the parasitic element 502 is arranged further thereabove. Although not illustrated in the cross-sectional view illustrated in FIG. 2B, power is supplied from a power supply line 53 to the power supply element 501.

In a thickness direction, the ground layer 41 is arranged between the patch antenna 50 and the power supply line connected to the first array antenna 21, the second array antenna 22, the third array antenna 23, and the fourth array antenna 24 (FIG. 2A), for example, the first power supply line 212 and the second power supply line 222. Accordingly, coupling between the antennas caused by the power supply line can be reduced.

The patch antenna 50 operates as a two-dimensional array antenna for boresight. A direction of the polarized waves excited when power is supplied from the first power supply point 51 to the patch antenna 50 is parallel to a direction of the polarized waves excited by the first array antenna 21 and the third array antenna 23. Accordingly, radio waves emitted from the patch antenna 50 and radio waves emitted from the first array antenna 21 and the third array antenna 23 can be phase-synthesized. Likewise, when power is supplied from the second power supply point 52 to the patch antenna 50, radio waves emitted from the patch antenna 50 and radio waves emitted from the second array antenna 22 and the fourth array antenna 24 can be phase-synthesized. Executing phase control with respect to the first array antenna 21, the second array antenna 22, the third array antenna 23, the fourth array antenna 24, and the patch antenna 50 to execute excitation makes it possible to change directivity in a wider range.

In the second embodiment as well, in the same manner as in the first embodiment, a configuration may be such that the array antennas are respectively arranged at three sides or two sides orthogonal to each other of the dielectric substrate 10, and the array antennas are not arranged at the other sides.

Third Embodiment

An antenna module according to a third embodiment will be described with reference to FIG. 3A to FIG. 3C. The following describe differences from the antenna module according to the first embodiment illustrated in FIG. 1A and FIG. 1B, and omit description of the common configuration.

Figure 3A:
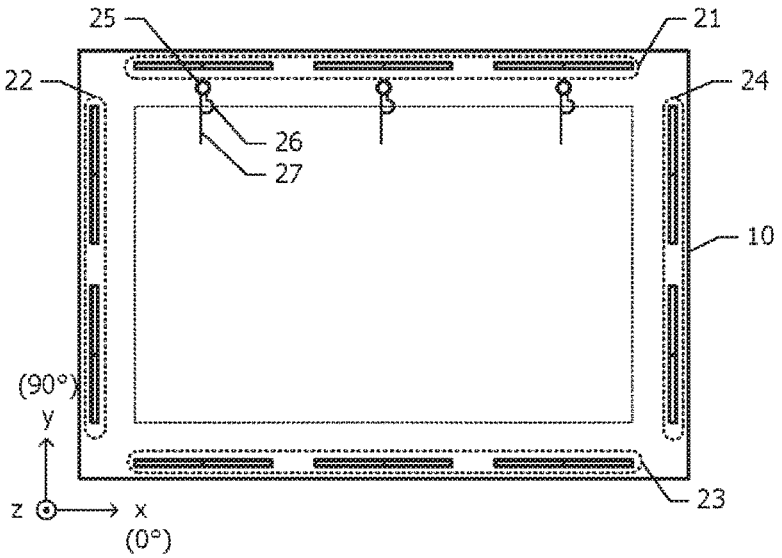
FIG. 3A is a plan view of an antenna module according to a third embodiment.

FIG. 3A is a plan view illustrating the antenna module according to the third embodiment. A vertical-type dipole antenna 25 which forms a pair with each of the dipole antennas of the first array antenna 21 is arranged. A balun 26 and a power supply line 27 are connected to the vertical-type dipole antenna 25.

Figure 3B:
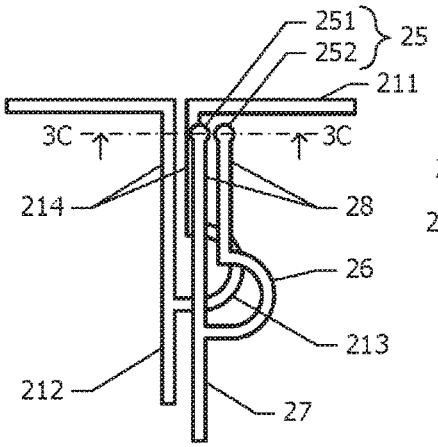
FIG. 3B is a plan view of a first dipole antenna and a vertical-type dipole antenna forming a pair therewith in an enlarged manner.

FIG. 3B is a plan view illustrating the first dipole antenna 211 and the vertical-type dipole antenna 25 forming a pair therewith in an enlarged manner. The vertical-type dipole antenna 25 is configured by a pair of conductor columns 251 and 252 extending in a thickness direction of the dielectric substrate 10. The one conductor column 251 partially overlaps with a first balanced power supply line 214 of the first dipole antenna 211, when viewed in a plan view. The first balun 213 and the first balanced power supply line 214 of the first dipole antenna 211 partially overlaps with a balanced power supply line 28 and the balun 26 of the vertical-type dipole antenna 25, when viewed in a plan view.

Figure 3C:
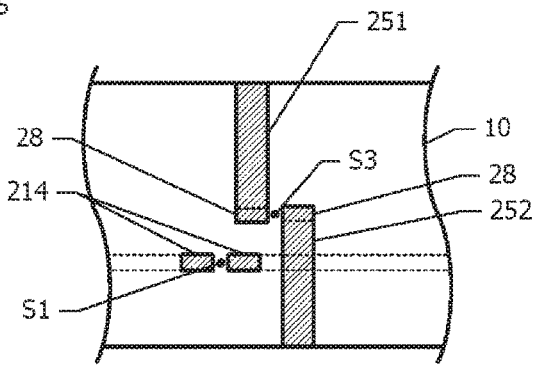
FIG. 3C is a cross-sectional view taken along a dot-dash line 3C-3C in FIG. 3B.

FIG. 3C is a cross-sectional view taken along a dot-dash line 3C-3C in FIG. 3B. The balanced power supply line 28 of the vertical-type dipole antenna 25 is arranged in a different layer from that of the first balanced power supply line 214 of the first dipole antenna 211. In the example illustrated in FIG. 3C, the balanced power supply line 28 is arranged above the first balanced power supply line 214. The conductor column 251 extends upward from the one balanced power supply line 28. The conductor column 252 extends downward from the other balanced power supply line 28. The vertical-type dipole antenna 25 (FIG. 3A) is configured by the conductor column 251 and the conductor column 252.

A cross dipole antenna is configured by the first dipole antenna 211 and the vertical-type dipole antenna 25 forming a pair therewith. Overlapping the one conductor column 251 of the vertical-type dipole antenna 25 with the first balanced power supply line 214 of the first dipole antenna 211 makes it possible to bring an intermediate point S1 between two power supply points of the first dipole antenna 211 and an intermediate point S3 between two power supply points of the vertical-type dipole antenna 25 closer to each other in the x-axis direction.

In the third embodiment, polarized waves in a direction perpendicular to the dielectric substrate 10 can be emitted in a direction parallel to the dielectric substrate 10.

In the third embodiment as well, in the same manner as in the second embodiment illustrated in FIG. 2A and FIG. 2B, the patch antenna 50 having directivity in boresight direction may be provided.

The embodiments described above are merely examples, and it goes without saying that partial replacements or combinations of configurations illustrated among different embodiments are also possible. The same actions and effects as in the same configurations in a plurality of embodiments are not stated for each embodiment. Furthermore, the present invention is not intended to be limited to the above-described embodiments. For example, it will be obvious to those skilled in the art that various changes, improvements, combinations, or the like can be made.

REFERENCE SIGNS LIST

10 DIELECTRIC SUBSTRATE
11-15 LAYER
21 FIRST ARRAY ANTENNA
22 SECOND ARRAY ANTENNA
23 THIRD ARRAY ANTENNA
24 FOURTH ARRAY ANTENNA
25 VERTICAL-TYPE DIPOLE ANTENNA
26 BALUN
27 POWER SUPPLY LINE
28 BALANCED POWER SUPPLY LINE
30 HIGH-FREQUENCY ELEMENT
41, 43, 45 GROUND LAYER
50 PATCH ANTENNA
51 FIRST POWER SUPPLY POINT
52 SECOND POWER SUPPLY POINT
53 POWER SUPPLY LINE
211 FIRST DIPOLE ANTENNA
212 FIRST POWER SUPPLY LINE
213 FIRST BALUN
214 FIRST BALANCED POWER SUPPLY LINE
221 SECOND DIPOLE ANTENNA
222 SECOND POWER SUPPLY LINE
223 SECOND BALUN
251, 252 CONDUCTOR COLUMN
501 POWER SUPPLY ELEMENT
502 PARASITIC ELEMENT
S1, S2, S3 INTERMEDIATE POINT OF POWER SUPPLY POINT

The invention claimed is:

1. An antenna module comprising:
a dielectric substrate;
a first dipole antenna included in a first layer of the dielectric substrate;
a second dipole antenna included in a second layer different from the first layer of the dielectric substrate, the second dipole antenna exciting a polarized wave in a direction orthogonal to a direction of a polarized wave excited by the first dipole antenna;
a first power supply line included in the first layer, the first power supply line supplying power to the first dipole antenna; and
a second power supply line included in the second layer, the second power supply line supplying power to the second dipole antenna,
wherein an operating frequency of the first dipole antenna and an operating frequency of the second dipole antenna are the same as each other;
a distance from an intermediate point between two power supply points of the first dipole antenna to an intermediate point between two power supply points of the second dipole antenna is no greater than an effective wavelength of the operating frequency; and
at least one of the first power supply line and the second power supply line has a triplate structure.

2. The antenna module according to claim 1, further comprising:
a first array antenna included in the first layer, the first array antenna including the first dipole antenna at an end portion as a single antenna element; and a second array antenna included in the second layer, the second array antenna including the second dipole antenna at an end portion as a single antenna element, wherein a direction in which the antenna element of the first array antenna is arrayed and a direction in which the antenna element of the second array antenna is arrayed are orthogonal to each other.

3. The antenna module according to claim 2, wherein the first array antenna and the second array antenna are arranged along sides of the dielectric substrate orthogonal to each other, and have directivity in a direction parallel to the dielectric substrate, the antenna module further comprising:

a patch antenna included in a third layer of the dielectric substrate different from the first layer and the second layer, wherein the patch antenna is arranged in a region further inward than the first array antenna and the second array antenna, when viewed in a plan view.

4. The antenna module according to claim 3, wherein the first power supply line and the second power supply line overlap with the patch antenna, when viewed in a plan view.

5. The antenna module according to claim 2, further comprising:

a vertical-type dipole antenna arranged to the dielectric substrate, the vertical-type dipole antenna forming a pair with each antenna element of the first array antenna, wherein the vertical-type dipole antenna includes a pair of conductor columns extending in a thickness direction of the dielectric substrate, the vertical-type dipole antenna configures a cross dipole antenna with the corresponding antenna element of the first array antenna.

6. The antenna module according to claim 3, further comprising:

a vertical-type dipole antenna arranged to the dielectric substrate, the vertical-type dipole antenna forming a pair with each antenna element of the first array antenna, wherein the vertical-type dipole antenna includes a pair of conductor columns extending in a thickness direction of the dielectric substrate, the vertical-type dipole antenna configures a cross dipole antenna with the corresponding antenna element of the first array antenna.

7. The antenna module according to claim 4, further comprising:

a vertical-type dipole antenna arranged to the dielectric substrate, the vertical-type dipole antenna forming a pair with each antenna element of the first array antenna, wherein the vertical-type dipole antenna includes a pair of conductor columns extending in a thickness direction of the dielectric substrate, the vertical-type dipole antenna configures a cross dipole antenna with the corresponding antenna element of the first array antenna.

* * * * *